US008534122B2

(12) United States Patent
Mironets et al.

(10) Patent No.: US 8,534,122 B2
(45) Date of Patent: Sep. 17, 2013

(54) AIRFLOW TESTING METHOD AND SYSTEM FOR MULTIPLE CAVITY BLADES AND VANES

(75) Inventors: Sergey Mironets, Norfolk, CT (US); Thomas R. Davis, Yalesville, CT (US); Richard Varsell, Bristol, CT (US); Edward Pietraszkiewicz, Southington, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 13/337,525

(22) Filed: Dec. 27, 2011

(65) Prior Publication Data

US 2013/0160535 A1 Jun. 27, 2013

(51) Int. Cl.
*G01M 15/14* (2006.01)

(52) U.S. Cl.
USPC ..... 73/112.01

(58) Field of Classification Search
USPC ..... 73/112.01
See application file for complete search history.

(56) References Cited

U.S. PATENT DOCUMENTS

| | | | | |
|---|---|---|---|---|
| 6,772,627 | B2 * | 8/2004 | Fleming | 73/147 |
| 6,923,051 | B2 * | 8/2005 | Fleming | 73/147 |
| 7,024,929 | B2 * | 4/2006 | Fleming et al. | 73/147 |
| 7,360,434 | B1 | 4/2008 | Hayes et al. | |
| 7,685,870 | B2 * | 3/2010 | Quinn et al. | 73/112.01 |
| 7,971,473 | B1 * | 7/2011 | Meunier et al. | 73/112.01 |
| 2002/0177978 | A1 * | 11/2002 | Obenhoff et al. | 702/188 |
| 2003/0209084 | A1 * | 11/2003 | Fleming | 73/861.74 |

* cited by examiner

*Primary Examiner* — Freddie Kirkland, III
(74) *Attorney, Agent, or Firm* — Bachman & LaPointe, P.C.

(57) ABSTRACT

A system for airflow testing a turbine engine component having multiple cavities has a test fixture with a module for supporting a turbine engine component to be tested and a sliding element for sequentially allowing a pressurized fluid to flow through each of the multiple cavities in the turbine engine component. A method for performing the airflow testing is also described.

17 Claims, 4 Drawing Sheets

AIRFLOW TESTING METHOD AND SYSTEM FOR MULTIPLE CAVITY BLADES AND VANES

BACKGROUND

The present disclosure relates to a method and a system for performing airflow testing on multiple cavity turbine engine components such as blades and vanes.

The existing airflow testing method for multiple cavity blade and vanes requires independent flow testing of each cavity while blocking others. This is achieved by using multiple seals with part specific sealing configurations. Each seal allows air to flow to one passage. All other passages on the root bottom of the blade or vane being tested are blocked. Typically, the sealing is done at the root bottom surface interface of the blade or vane. Upstream of the bottom surface interface, air is supplied to a seal using one channel. For example, if one considers a blade with three passages, i.e. trailing edge (TE), middle cavity (MC), and leading edge (LE) passages, in order to complete the TE total flow test, a TE seal is needed to block the MC and LE passages and leave only the TE passage unobstructed. To complete all three flows using the existing airflow testing method, three independent set ups and three seals are needed. For every set up change, an operator must perform system diagnostics and actual parts testing. The diagnostic testing is time consuming and consists of a seal restriction test, a part leak test, and a master part test. As a result, for a blade with three cavities, three independent set ups need to be performed and a single batch of parts need to be tested three times for TE, MC, and LE passages. Thus, the existing system has long cycle times and allows parts processing in batches only. It is not possible to test a single piece flow.

In addition to total flow, a P-Tap testing of specific holes is required. The existing method uses manual P-Tap probes. This manual method has some deficiencies in accuracy, productivity, and ergonomic problems.

SUMMARY

Accordingly, it is desirable to have an airflow testing method and system which enables total flow testing of blades and vanes with multiple cavities using a single set up.

In accordance with the present disclosure, there is provided a system for airflow testing a turbine engine component having multiple cavities which broadly comprises a test fixture having means for supporting a turbine engine component to be tested and means for sequentially allowing a pressurized fluid to flow through each of the multiple cavities in the turbine engine component.

In accordance with the present disclosure, there is provided a method for airflow testing a turbine engine component having at least two cavities which broadly comprises the steps of providing a test fixture having a sliding element with one hole and a solid portion; positioning the turbine engine component within the test fixture; sequentially allowing a pressurized fluid to flow through each of the multiple cavities in the turbine engine component; and the sequentially allowing step comprising moving the sliding element so that the one hole is aligned with a first one of the cavities and the solid portion blocks at least a second one of the cavities.

Other details of the airflow testing method and system for multiple cavity blades and vanes are set forth in the following detailed description and the accompanying drawings wherein like reference numerals depict like elements.

DETAILED DESCRIPTION

As discussed above, there is provided herein a method and a system for airflow testing a turbine engine component having at least two cavities, such as a blade or a vane used in a turbine engine.

The airflow testing system described herein enables total flow testing of turbine engine components with multiple cavities or passages using a single set up. This can be achieved by opening air flow to one of the cavities and blocking other cavities in the turbine engine component upstream of the turbine engine component's root bottom surface interface. In this system, the seal is provided with multiple openings and air is supplied to the seal using separate passages. Each of the passages is connected to the corresponding cavities on the turbine engine component's root bottom. Thus, when a three cavity component has a seal with trailing edge, middle cavity, and leading edge openings, each of the three openings is connected to separate passages. Thus, the trailing edge passage total flow is conducted by letting air through the trailing edge passage only and blocking the middle cavity and leading edge passages. The sequence of opening and closing the corresponding passages allows for components with multiple passages to be tested in one set-up without any process changeover.

The airflow testing system described herein also allows for automatic P-Tap testing using probes that are targeted to specific cooling film holes in an airfoil portion of the turbine engine component. The probes may be engaged automatically after the total flow is stabilized.

The entire sequence of individual cavities total flow and the corresponding P-Tap testing of the cooling film holes may be controlled by software and may be performed without operator interference.

Figure 1:
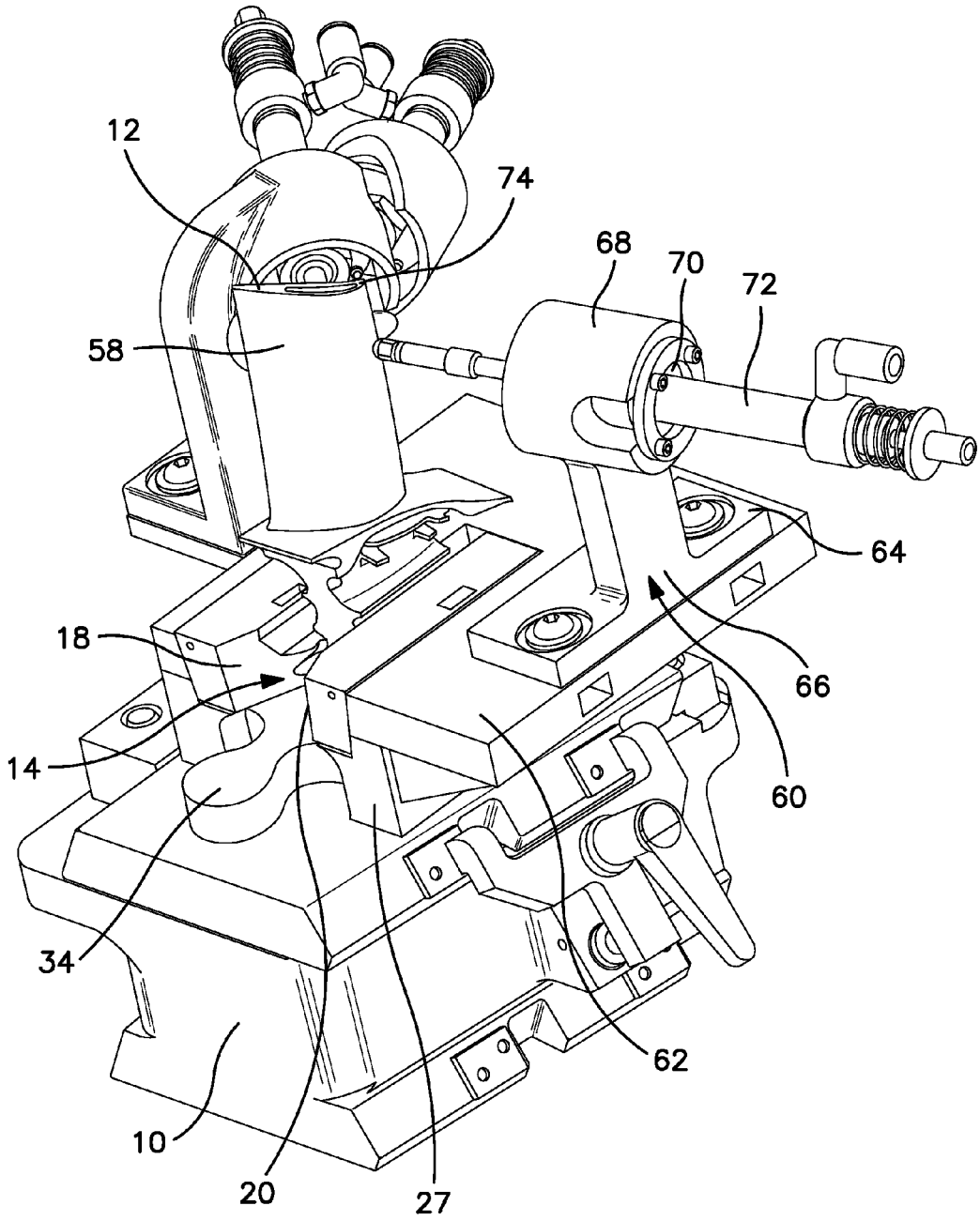
FIG. 1 is a perspective view of a test fixture used in a method for airflow testing multiple cavity turbine engine components.

Referring now to FIG. 1 of the drawings, there is shown a test fixture 10 for holding a turbine engine component 12 having multiple cavities or passages, such as a blade or vane. The fixture 10 is provided with a first module 27 having a slot 14 for receiving a root portion 16 of the turbine engine component 12. If desired, the slot 14 may have side walls 18 and 20 configured to mate with the shape of the sidewalls of the root portion 16.

Figure 2:
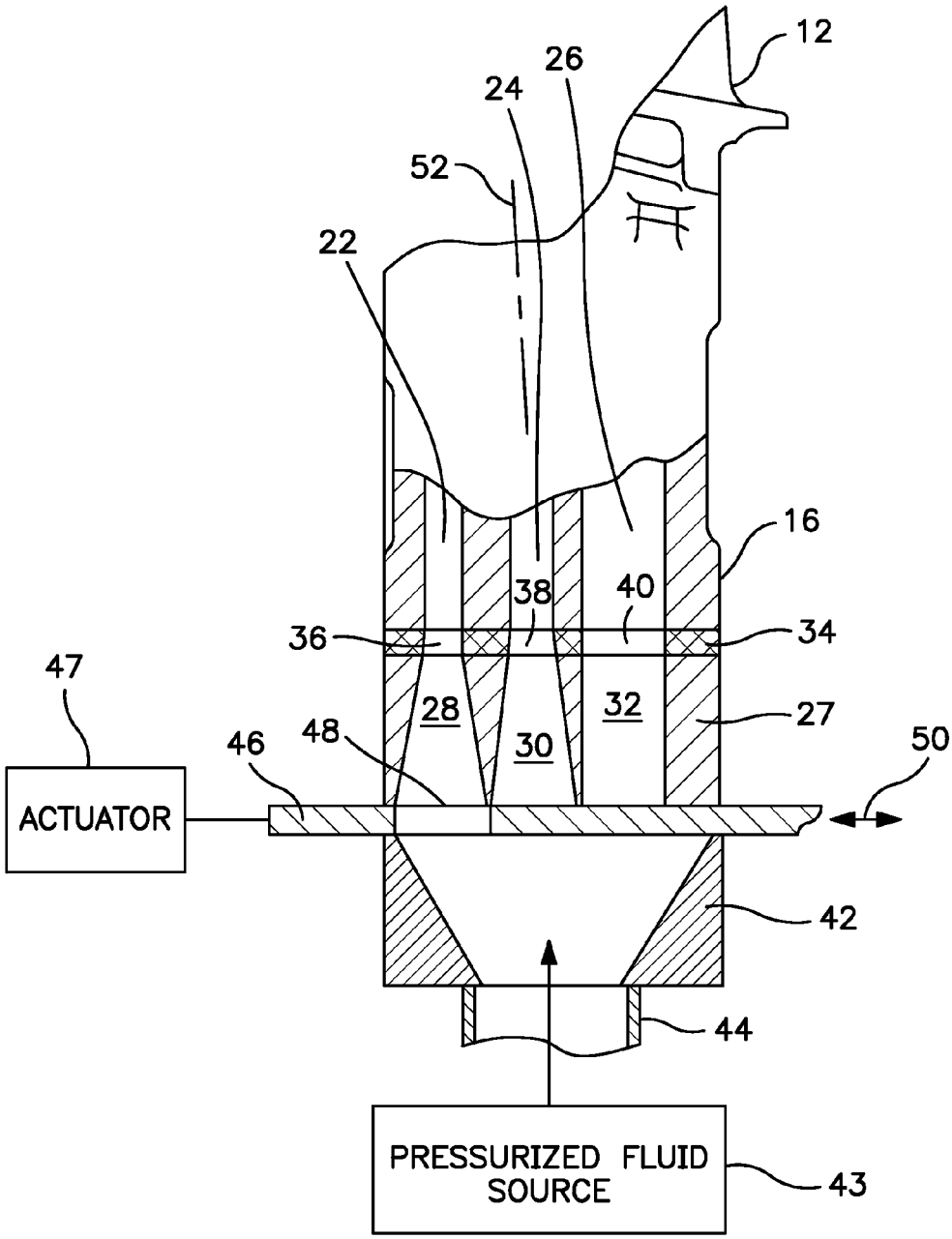
FIG. 2 is a sectional view of a portion of the test fixture of FIG. 1.

The turbine engine component 12 may have multiple cavities or passages as shown in FIG. 2. For example, the multiple cavities or passages may include a leading edge passage 22, a middle cavity passage 24, and a trailing edge passage 26. The first module 27 has individual and separate passages 28, 30, and 32 which align with the passages 22, 24, and 26 respectively. An insert 34, which acts a seal, may be positioned between the root portion 16 of the turbine engine component 10 and the first module 27. The insert 34 may be formed from any suitable seal material such as a polymer material. The insert 34 has three individual and separate holes 36, 38, and 40 which align with the aforementioned passages 22, 24, and 26 and 28, 30, and 32. As shown in FIG. 2, the fixture 10 also has a second module 42 which communicates with a source 43 of a pressurized fluid, such as pressurized air, via conduit 44. A sliding element 46 is positioned between the first module 27 and the second module 42. The sliding element 46 is provided with a single hole 48 which can be aligned with one of the passages 28, 30, and 32 and consequently with one of the passages 22, 24, and 26. The remainder of the sliding element 46 is solid for blocking the flow of the pressurized fluid to the others of the passages 28, 30, and 32 and the passages 22, 24, and 26.

The sliding element 46 is reciprocably movable in a direction 50 parallel to a longer side of the root portion 16 of the turbine engine component 12. By aligning the hole 48 in the sliding element 46 with one of the passageways 28, 30, and 32, pressurized fluid may be delivered to only one of the passageways 22, 24, and 26 in the turbine engine component 12. The solid portions of the sliding element 46 block the remaining passages 28, 30, and 32 in the first module 27 and thus the remaining ones of the passages 22, 24, and 26 in the turbine engine component 12. After one has completed the testing of one of the passages 22, 24, and 26, the sliding element 46 may be moved so that the hole 48 is aligned with another one of the passages 28, 30, and 32 so that a different one of the passages 22, 24, and 26 can be tested. The sliding element 46 may be moved manually if desired, or automatically via an actuator 47 such as a linear motion actuator. By operating the sliding element 46 in this manner, the passages 22, 24, and 26 may be sequentially tested in any desired order.

Software controls may be used to align the hole 48 with the passages 22, 24, and 26 in the turbine engine component 12. The software may also be used to select sonic nozzles to be used during the test and may also be used to engage the automatic P-Tap probes 72, 76, and 78. As will be discussed hereinafter, the P-tap probes 72, 76, and 78 may be targeted to specific cooling film holes in an airfoil portion 58 of the turbine engine component 12. The P-tap probes 72, 76 and 78 each have a flexible tip which comes into contact with a particular cooling film hole on the airfoil portion of the turbine engine component 12. The opposite end of each P-tap probe 72, 76, and 78 is connected to a processor (not shown) that detects the pressure sensed by the probes 72, 76 and 78 and outputs a result.

Referring now to FIG. 1, there is shown a holder 60 mounted to an upper surface 62 of the fixture 10. The holder 60 has a base plate 64, a support member 66 integrally formed with the base plate 64, and an annular support 68 integrally formed with the support member 66. The annular support 68 has an aperture 70 into which a targeted P-tap probe 72 may be inserted. The P-tap probe 72 may be secured to the holder 60 using any suitable means known in the art. The P-tap probe 72 is preferably targeted towards a cooling film home at the leading edge 74 of the turbine engine component 12.

Figure 3:
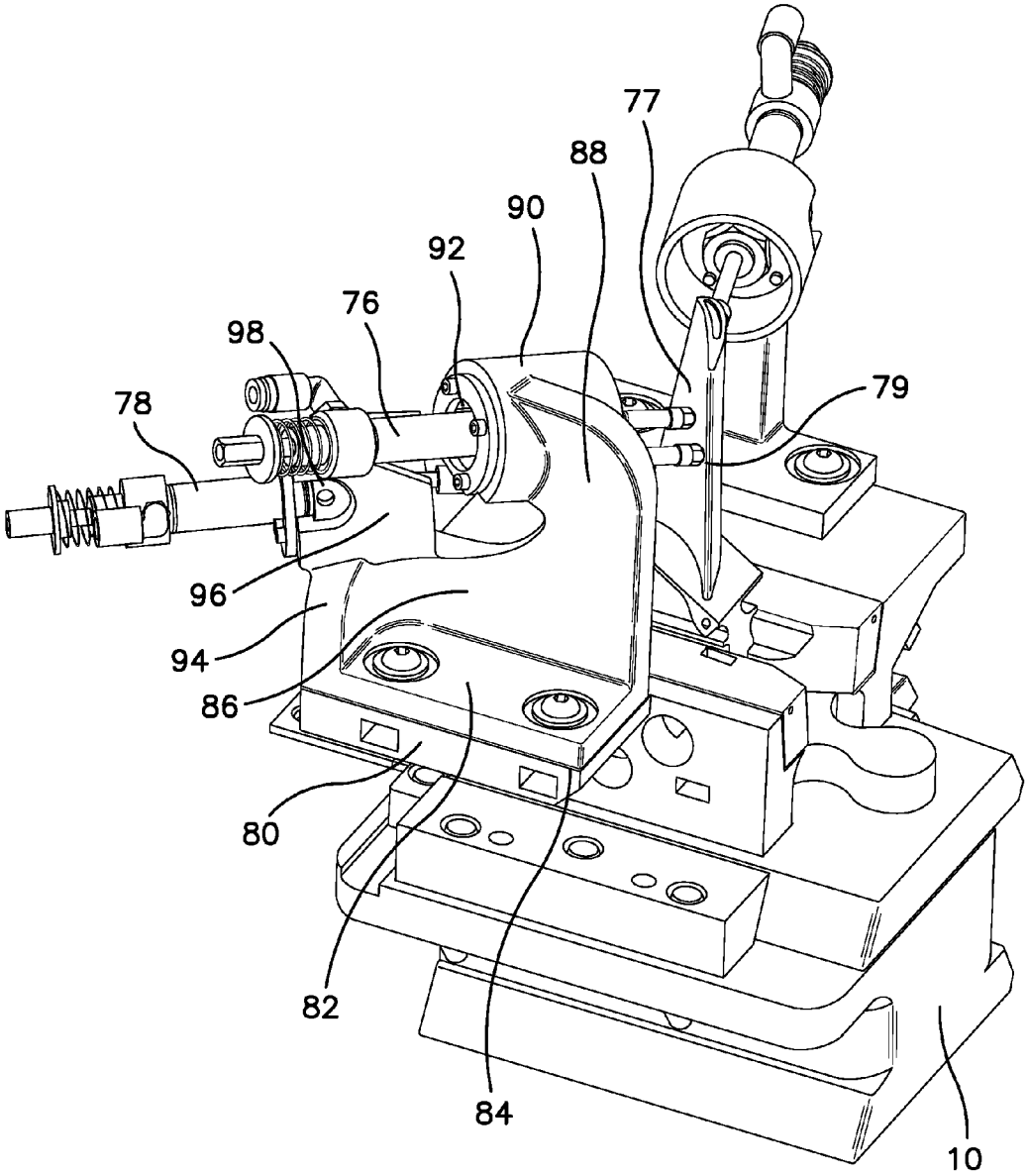
FIG. 3 is an opposite side perspective view of the test fixture of FIG. 1.

Referring now to FIG. 3, there is shown a holding system 80 for targeted P-tap probes 76 and 78. The targeted P-tap probe 76 is targeted at a mid chord portion 77 of the turbine engine component 12, while the targeted P-tap probe 78 is targeted at the trailing edge 79 of the turbine engine component 12.

The holding system 80 includes a base plate 82 which is mounted to a surface 84 of the fixture 10. The holding system 80 includes an upright web 86 which is integrally formed with the base plate 82. The web 86 includes an arm 88 to which an annular holder 90 is integrally formed. The annular holder 90 is aligned at an angle with respect to the web 86 so that when the P-tap probe 76 is inserted in the aperture 92 and mounted to the holder 90, it is pointed at the mid chord portion 77. The web 86 further has an integrally formed angled portion 94 to which another annular holder 96 is joined. The annular holder 96 has an aperture 98 which is aligned so that when the P-tap probe 78 is inserted in the aperture 98 and is joined to the holder 96, the probe 78 is pointed at the trailing edge 79 of the turbine engine component 12.

Figure 4:
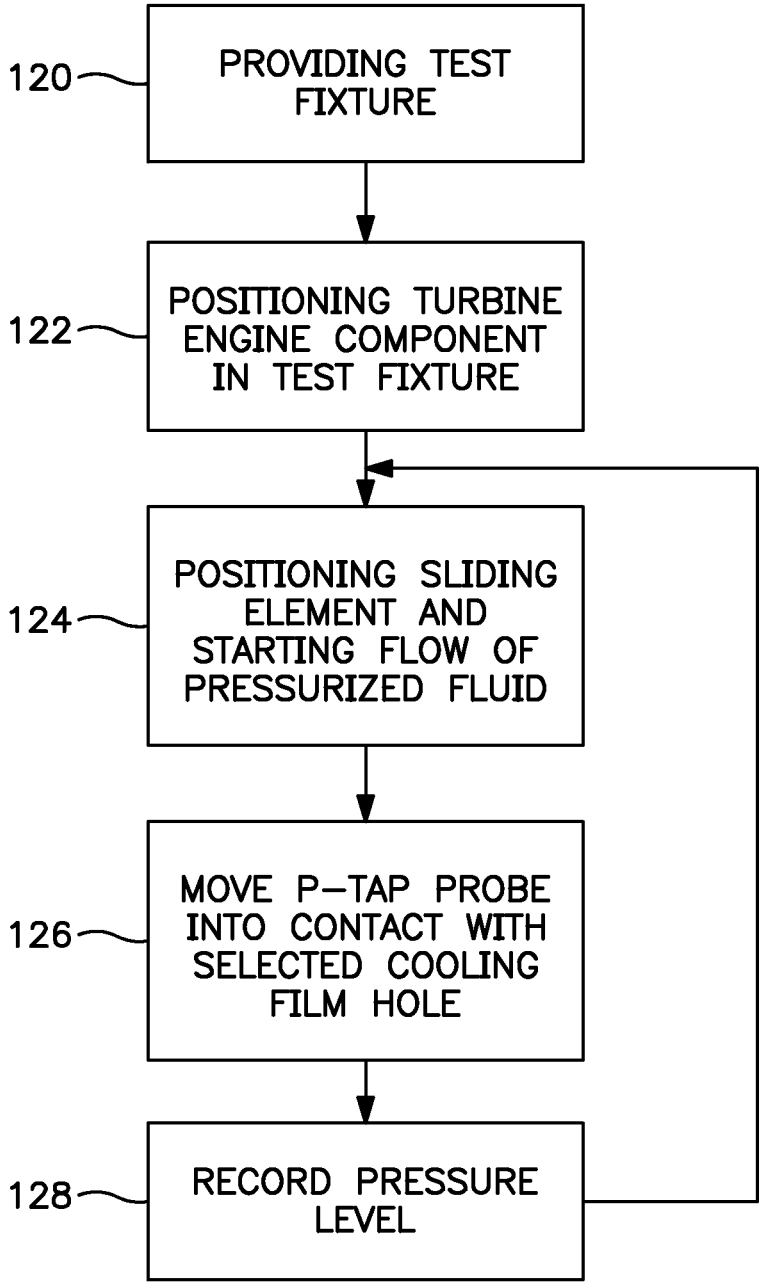
FIG. 4 is a flow chart showing the steps of the airflow testing method.

Referring now to FIG. 4, the method for performing the airflow test of the turbine engine component 12 comprises in step 120, providing the test fixture 10 having the sliding element 46 with the hole 48 and the solid portion. In step 122, the turbine engine component 12 to be test is positioned within the test fixture 10. Thereafter, in step 124, the sliding element 46 is positioned so that the hole is aligned with one of the passages 22, 24, and 26 of the turbine engine component 12. Pressurized fluid is then allowed to flow into the open one of the passages 22, 24, and 26. In step 126, when the flow is stabilized, one of the P-tap probes 72, 76 and 78 may be automatically moved into contact with a selected one of the cooling film holes. In step 128, the pressure level of the selected cooling film hole is recorded when the pressure readings for the selected cooling film hole is stable. Thereafter, the sequence of steps 124, 126, and 128 is repeated for each of the remaining passages 22, 24, and 26 in the turbine engine component 12.

There are a number of advantages to the airflow testing method and system. For example, the set up time is reduced by allowing multiple airflow passages on a blade to be tested with a single set up, rather than requiring many separate set ups. Further there is a cycle time reduction because the static probe testing under the method described herein is performed automatically by energizing P-tap probes to specific holes after the total pressure is stabilized, rather than performing the testing using manual probes. Still further, quality assurance may be improved by enabling the testing to be performed without operator interference. Yet further, the advantages include ergonomic advantages in that manual P-Tap probe testing and multiple tooling set ups are not needed.

There has been provided in accordance with the instant disclosure an airflow testing method and system for multiple cavity turbine engine components. While the airflow testing method and system have been described in the context of specific embodiments thereof, other unforeseen alternatives, modifications, and variations may become apparent to those skilled in the art having read the foregoing description. Accordingly, it is intended to embrace those alternatives, modifications, and variations as fall within the broad scope of the appended claims.

What is claimed is:

1. A system for airflow testing a turbine engine component having multiple cavities comprising: a test fixture having means for supporting a turbine engine component to be tested and means for sequentially allowing a pressurized fluid to flow through each of the multiple cavities in said turbine engine component, said supporting means comprising a first module having a slot for receiving a portion of said turbine engine component, and said means for sequentially allowing said pressurized fluid to flow through each of the multiple cavities comprises a slider having one hole for allowing said pressurized fluid to flow into one of said multiple cavities and a solid portion for preventing said pressurized fluid from flowing into at least one remaining cavity of said multiple cavities.

2. The system of claim 1, wherein said portion is a root portion of said turbine engine component.

3. The system of claim 1, wherein said first module has a plurality of individual flow passages aligned with respective ones of the multiple cavities in the turbine engine component.

4. The system of claim 1, wherein said slider may be manually operated to move in a direction parallel to a longer side of a root portion of said turbine engine component.

5. The system of claim 1, wherein said slider may be operated by an actuator to move in a direction parallel to a longer side of a root portion of said turbine engine component.

6. The system of claim 1, wherein said test fixture further comprises a second module and said slider is positioned between said second module and said first module.

7. The system of claim 6, wherein said second module is connected to a source of said pressurized fluid.

8. The system of claim 7, wherein said pressurized fluid is pressurized air.

9. The system of claim 6, wherein said test fixture further comprises an insert located between said root portion of said turbine engine component and said first module.

10. The system of claim 1, wherein said test fixture further comprises a plurality of targeted probes for measuring fluid pressure exiting from cooling holes in an airfoil portion of said turbine engine component.

11. The system of claim 10, wherein said test fixture has means for holding one of said targeted probes mounted to a first side.

12. The system of claim 11, wherein said test fixture has means for holding remaining ones of said targeted probes mounted to a second side opposed to said first side.

13. A method for airflow testing a turbine engine component having at least two cavities comprising the steps of:

providing a test fixture having a sliding element with one hole and a solid portion;

positioning the turbine engine component within the test fixture;

sequentially allowing a pressurized fluid to flow through each of the multiple cavities in said turbine engine component; and said sequentially allowing step comprising moving said sliding element so that said one hole is aligned with a first one of said cavities and said solid portion blocks at least a second one of said cavities.

14. The method of claim 13, wherein said sequentially allowing step further comprises moving said sliding element so that said one hole is aligned with said second one of said cavities and said solid portion blocks said first one of said cavities.

15. The method of claim 14, wherein said sequentially allowing step further comprises moving said sliding element so that said one hole is aligned with a third cavity and said solid portion blocks said first and second ones of said cavities.

16. The method of claim 13, further comprising positioning a P-tap probe against a selected cooling hole in an airfoil portion of said turbine engine component.

17. The method of claim 16, further comprising recording a pressure level of the selected cooling hole when pressure readings for the selected cooling hole are stable.

* * * * *